United States Patent [19]

Wiedemann

[11] 3,992,205

[45] Nov. 16, 1976

[54] ELECTROPHOTOGRAPHIC RECORDING MATERIAL CONTAINING A PLURALITY OF DYES WITH DIFFERENT SPECTRAL ABSORBTION CHARACTERISTICS

[75] Inventor: Wolfgang Wiedemann, Geisenheim-Johannisberg, Germany

[73] Assignee: Hoechst Aktiengesellschaft, Germany

[22] Filed: Oct. 22, 1974

[21] Appl. No.: 517,031

[52] U.S. Cl. ..... 96/1.6; 96/1.5; 252/501

[51] Int. Cl.[2] ..... G03G 5/09

[58] Field of Search ..... 96/1.6, 1.5; 252/501

[56] References Cited

UNITED STATES PATENTS

| | | | |
|---|---|---|---|
| 3,357,989 | 12/1967 | Byrne et al. | 96/1.5 |
| 3,870,516 | 3/1975 | Smith et al. | 96/1.6 |
| 3,871,882 | 3/1975 | Wiedemann | 96/1.6 |

*Primary Examiner*—David Klein
*Assistant Examiner*—Judson R. Hightower
*Attorney, Agent, or Firm*—James E. Bryan

[57] ABSTRACT

This invention relates to electrophotographic recording material comprising an electrically conductive carrier material having thereon a photoconductive multilayer system of a charge carrier producing dyestuff layer or organic material and an insulating, organic, covering layer thereon with at least one charge carrier transporting compound, said dyestuff layer comprising at least two pigment dyes absorbing in different spectral regions, i.e. in the region of relatively long waves and in the region of relatively short waves.

22 Claims, 9 Drawing Figures

1/E1/2
0,7
0,5
0,3
0,1
1
2
λ (nm)
400
500
600
700

Formulae
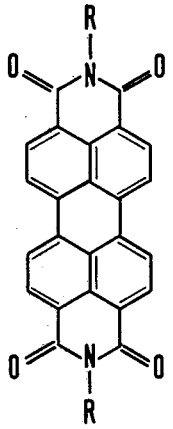
(1)
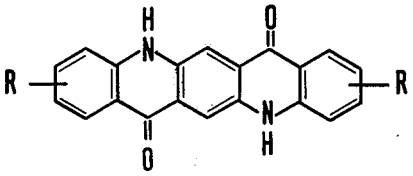
(2)
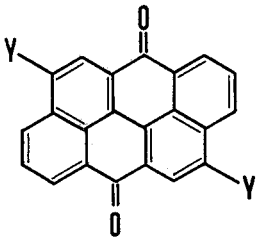
(3)

(4)
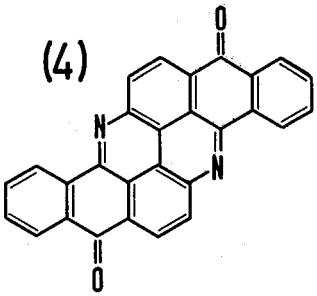
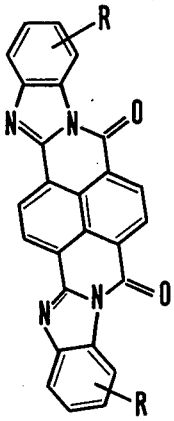
(5)
(6)
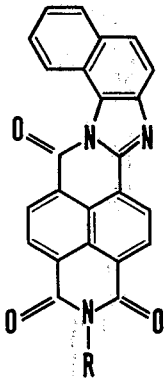

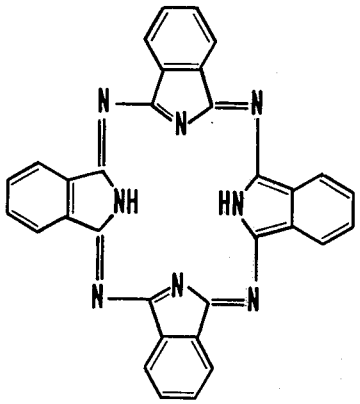
(7)
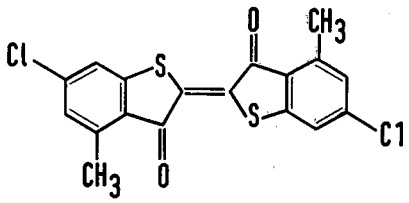
(8)
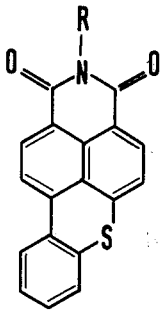
(9)

ELECTROPHOTOGRAPHIC RECORDING MATERIAL CONTAINING A PLURALITY OF DYES WITH DIFFERENT SPECTRAL ABSORBTION CHARACTERISTICS

This invention relates to an electrophotographic recording material comprising an electrically conductive carrier material having thereon, optionally together with an intermediate adhesive layer, a photoconductive multi-layer system of a charge carrier producing dyestuff layer of organic material and of an insulating, organic, preferably transparent, covering layer thereon with at least one charge carrier transporting compound.

Photoconductive multi-layer systems are known from German Offenlegungsschriften Nos. 2,108,958; 2,108,935; 2,108,944; 2,108,992; 2,108,968; 2,108,984; and 2,108,938, for example, which disclose systems with layers of dyestuffs which are effective in different regions of the spectrum. However, they have a considerably reduced photosensitivity, either in the spectral region of relatively short waves, approximately between 420 and 500 nm, as in the case of blue pigment dyes, or in the spectral region of relatively long waves, approximately from 620 nm, as in the case of red pigment dyes.

It is also known that selenium layers are very sensitive in the blue-green region of the spectrum, but practically insensitive in the red region thereof. It has been suggested, by arranging an additional phthalocyanine dispersion layer above a vapor-deposited selenium layer, according to German Offenlegungsschrift No. 1,622,367, or between the carrier material and the vapor-deposited selenium layer, according to German Offenelgungsschriften Nos. 1,597,877 and 1,797,342, to extend the photosensitivity into the spectral region of longer waves. It has been found that the reproducible production of phthalocyanine dispersion layers is difficult. A further disadvantage is the reduced optical permeability of the selenium or phthalocyanine layers for the layer beneath. Furthermore, the surface is subjected to wear during copying, which also considerably impairs the photosensitivity in the case of a thin vapor-deposited selenium layer, for example.

The object of the present invention thus is to provide an electrophotographic recording material which has a high photosensitivity, i.e. a panchromatic sensitivity, in the visible region of the spectrum of 420 to 750 nm.

The present invention provides an electrophotographic recording material comprising an electrically conductive carrier material having thereon, optionally together with an intermediate adhesive layer, a photoconductive multi-layer system of a charge carrier producing dyestuff layer of organic material and of an insulating, organic, preferably transparent, covering layer thereon with at least one charge carrier transporting compound, in which the dyestuff layer is composed of at least two pigment dyes absorbing in different spectral regions, i.e. in the region of relatively long waves and in the region of relatively short waves. Preferably, the component absorbing in the region of relatively long waves is a phthalocyanine dyestuff. In a particularly preferred embodiment, the component absorbing in the region of relatively long waves in a metal-free phthalocyanine.

By means of the invention, it is achieved that the described disadvantages are overcome and an electrophotographic recording material is provided which has a relatively constant, high photosensitivity over the total visible region of the spectrum, i.e. from about 420 to about 750 nm.

The invention will be further illustrated with reference to the accompanying FIGS. 1 to 3 which show different multi-layer systems.

Figure 1:
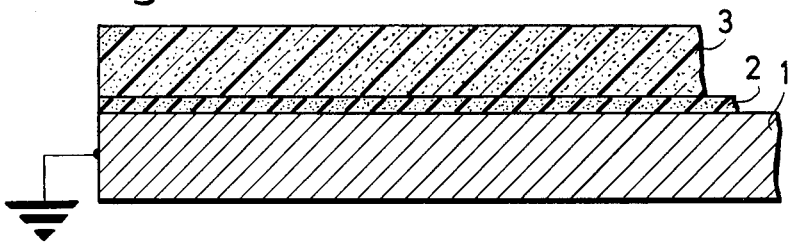
FIG. 1 shows one embodiment of the recording material of the invention.

FIG. 1 shows a recording material composed of an electrically conductive carrier material 1, an opaque homogeneous layer 2 of at least two pigment dyes, and the insulating organic, photoconductive covering layer 3. As a variation of this embodiment, in FIG. 2, the dyestuff layer is divided into the pigment dyestuff component 2' absorbing in the region of relatively long waves and adjacent to the electrically conductive carrier material 1, and into the pigment dyestuff component 2 arranged thereon and absorbing in the region of relatively short waves. The covering layer 3 thereon acts as a charge carrier transport layer. It is preferably transparent to visible light and, optionally in combination with binders, is composed of monomeric or polymeric charge transport compounds. FIG. 3 shows the electrically conductive carrier material as a foil (1, 4) to which metal has been applied by vapor-deposition and which additionally has an intermediate adhesive layer 5 preventing charge carrier injection in the dark.

The illustrated layer arrangements either may be flexible and applied to web material or, when using abrasion-resistant resin components, applied to photoconductor drums. They are employed in copying devices as electrophotographic recording media and can be used for cyclic operations.

The preferably used electrically conductive carrier material is aluminum foil, or optionally transparent polyester film to which aluminum has been applied by vapor-deposition or which has been laminated with aluminum but any sufficiently conductive carrier material may be used. The introduction of an organic intermediate layer 5 according to FIG. 3, optionally also of a thermally, anodically or chemically produced aluminum oxide intermediate layer, has the purpose, for example, to reduce the charge carrier injection from the metal into the photoconductor layer in the dark and, on the other hand, the charge flow during exposure to light should not be impeded. The intermediate layer acts as a barrier layer. The intermediate layer serves to substantially improve the adhesion between the electrically conductive carrier surface and the dyestuff layer.

For the intermediate layer, there may be used various natural or synthetic resin binders, but preferably materials are used which have a good adhesion to a metal or aluminum surface and, during subsequent application of the covering layer, are dissolved to a small extent, such as polyamide resins or polyvinyl phosphonic acid.

The thickness of such organic intermediate layers may be up to 5 μm and that of the aluminum oxide layer generally in the range of $10^2$ to $10^4$ A.

The organic dyestuff layer determines in particular the spectral light-sensitivity of the multi-layer system by the absorption or reflectance behavior of the dyestuffs present.

Figure 4:
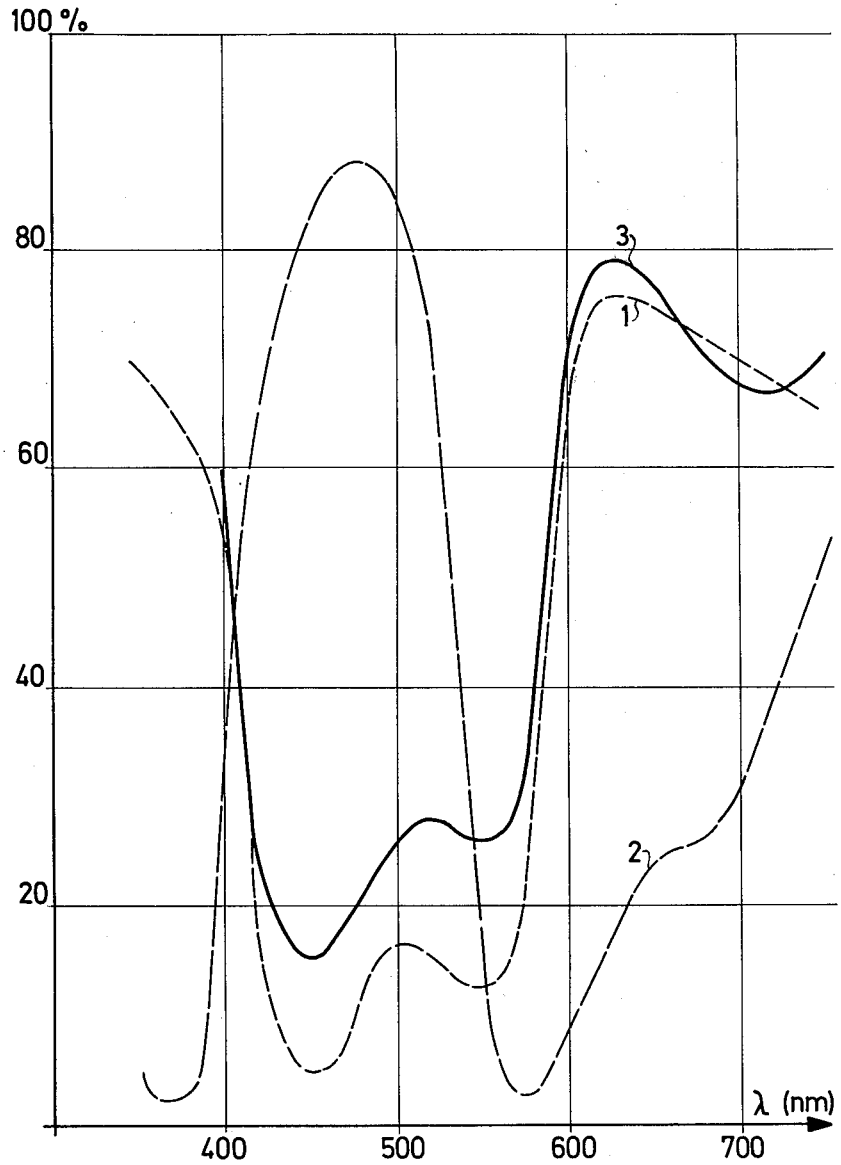
FIG. 4 illustrates the reflectance behavior of two dyestuffs.

It is known from the spectral light-sensitivity curves of photoconductive double layer systems with red or blue pigment dyes that they have a very good sensitivity only in partial regions. This is illustrated in the attached FIG. 5 by the examples N,N-dimethyl-perylene-3,4,9,10-tetracarboxylic acid diimide (Curve 1) and metal-free phthalocyanine (Curve 2). Analogous is the reflectance behavior of these dyestuffs, which is shown in FIG. 4. The combination of the dyestuffs at the ratio by weight of 97 : 3, however, results in an only slightly changed behavior as to reflectance (FIG. 4, Curve 3). This shows that the light-sensitivity can be only slightly improved by the combination of the pigment dyes. It surprisingly has been found, however, that a markedly improved red sensitivity is obtained when only small amounts of the blue dyestuff pigment are added. This is proved with light sources, such as xenon high-pressure lamps, which emit uniformly over the total visible spectral region. Still more apparent is this effect of the improved red sensitivity when a tungsten lamp with a higher emission in the red spectral region is used. It further has been found that the red sensitivity can be further increased with the increase of the portion of blue dyestuff pigment but that, parallel thereto, the dark conductivity increases and the chargeability of the multi-layer system decreases.

According to the invention, the addition of blue pigment dyestuff component thus is kept below a ratio by weight of about 1 : 1. Preferably, dyestuff combinations are employed in which the content of the component absorbing in the region of relatively long waves, calculated on the total dyestuff, is about 0.5 to 40 per cent by weight. It has been found that such a portion up to about 15 per cent by weight, calculated on the total dyestuff, is sufficient in special cases to achieve a markedly improved red sensitivity. Preferably, however, those mixtures are used which contain a portion of the component absorbing in the region of relatively long waves which is only about 0.5 to about 6 per cent by weight.

Accordingly, even a relatively small addition effects a substantial increase of the red sensitivity without other parameters, such as dark decay or chargeability, being influenced thereby.

The action mechanism of the photoconductive double layers is to be imagined as follows, $F_1$ standing for a red and $F_2$ for a blue dyestuff:

$$\left.\begin{array}{l} F_1 \xrightarrow{h\nu_1} F_1^* \\ F_2 \xrightarrow{h\nu_2} F_2^* \end{array}\right\} \text{excitation}$$

-continued $$\left.\begin{array}{l} F_1^* + F_1 \rightarrow F_1^{\cdot +} + F_1^{\cdot -} \\ F_2^* + F_2 \rightarrow F_2^{\cdot +} + F_2^{\cdot -} \end{array}\right\} \text{charge separation}$$

Excitation takes place in the characteristic region and energy transitions of the following kind $F_1^* + F_2 \rightarrow F_1 + F_2^*$ may also occur. After the excition of the dyestuffs, charge separation into dyestuff radical ions take place, as stated.

At the boundary surface between the dyestuff layer and the covering layer, reactions of the excited dyestuff molecules or of the formed dyestuff radical ions with the molecules of the charge transport compound are possible according to the following equations (depending on the use of a p- or an n-conducting charge transport compound; the higher sensitivity is to be found with a negative charge or with a positive charge):

a. Negative charge, p-transport compound (p-conductor), in the dyestuff layer: n-conduction $$\begin{array}{lcl} F^{\cdot +} + pL & \rightleftarrows & F + pL^{\cdot +} \\ pL^{\cdot +} + pL & \rightleftarrows & pL + pL^{\cdot +} \\ F^{\cdot -} + F & \rightleftarrows & F + F^{\cdot -} \end{array}$$

b. Positive charge, N-transport compound (n-conductor), in the dyestuff layer: p-conduction $$\begin{array}{lcl} F^{\cdot -} + nL & \rightleftarrows & F + nL^{\cdot -} \\ nL^{\cdot -} + nL & \rightleftarrows & nL + nL^{\cdot -} \\ F^{\cdot +} + F & \rightleftarrows & F + F^{\cdot +} \end{array}$$

Figure 2:
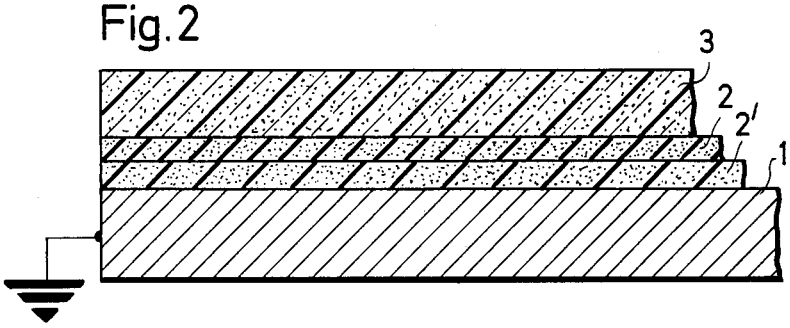
FIG. 2 shows a second embodiment of the recording material of the invention.
Figure 3:
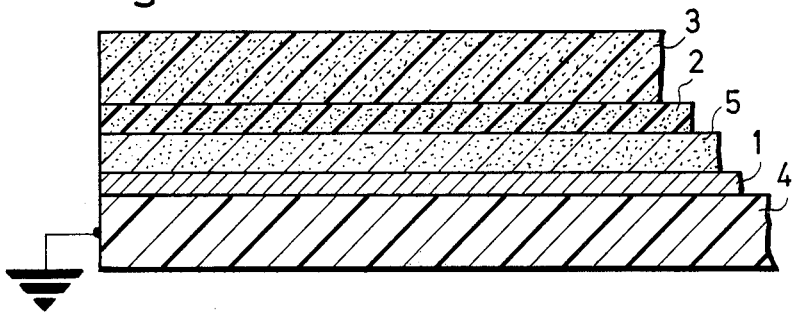
FIG. 3 shows a third embodiment of the recording material of the invention.

By the arrangement shown in FIGS. 1 to 3, it is possible that, in the tightly packed dyestuff layer, after homogeneous excitation, the charge carriers are further transported with low expenditure of energy through the relatively thin dyestuff layer. Compared with non-intermittently sensitized photoconductor layers of the known kind, there is the further advantage that, after injection of the charge carriers (electrons or holes) at the boundary layer, a directional homogeneous transport of a charge carrier kind occurs through the corresponding covering layer.

The production of the homogeneous dyestuff layers may be performed according to various methods. Such methods are the application by mechanically rubbing the most finely powdered dyestuff material into the electrically conductive carrier material, the application by chemical deposition of a leucobase to be oxidized, for example, the application by electrolytic or electrochemical processes or the spray gun method. The application preferably is performed, however, by vapor-depositing the dyestuffs onto the carrier material in a vacuum of about $10^{-3}$ to $10^{-5}$ mm Hg.

By vapor-deposition, layers with closely coherent dyestuff molecules are obtained. This has the advantage that a thin dyestuff layer is produced which renders possible an optimum charge carrier production rate in the dyestuff layer, the high extinction of the dyestuffs offering a high concentration of excited dyestuff molecules, and permits charge transport through the tightly packed dyestuff layer without any impedance by binders present.

Charge transport through the dyestuff layer is further fostered in that the vapor-deposited dyestuff layer may be very thin for producing optimum sensitivities in the double-layer arrangement. An advantageous layer thickness range of the vapor-deposited dyestuff in the mixed phase is between about 0.005 and about 2 $\mu$m. Particularly preferable is a layer thickness range between about 0.005 and about 0.5 $\mu$m since, in this case, the adhesion and homogeneity of the vapor-deposited dyestuff are particularly favorable.

Various methods may be used for the reproducible production of vapor-deposited layers with pigment dye combinations. A dyestuff mixture may be vapor-deposited the dyestuff components of which have vaporization speeds similar to one another under the given vapor-deposition conditions. This is the case, for example, when vapor-depositing a preferably used mixture of 97 parts of N,N'-dimethylperylene-3,4,9,10-tetracarboxylic acid diimide and 3 parts of phthalocyanine (metal free).

It is also possible to vapor-deposit the individual pigment dyes from differently adjustable vaporization sources, the dyestuffs to be vapor-deposited preferably being arranged in a series of vaporization vessels which are uniformly indirectly heated. When using five vaporization vessels, for example, it is possible to vapor-deposit under uniform conditions the red dyestuff from three vessels and the blue dyestuff from two vessels.

Vapor-deposition, however, also may be performed in successive vapor-deposition steps. The dyestuff absorbing in the region of relatively long waves being arranged beneath the dyestuff absorbing in the region of the relatively short waves.

The thicknesses of the individual pigment dyestuff layers optimally are in the range from about 0.001 to about 0.15 g/m$^2$. Particularly preferable thickness ranges are between about 0.03 and 0.1 g/m$^2$ for the blue dyestuff layer and in the range between about 0.05 and about 0.12 g/m$^2$ for the orange dyestuff layer, these values, with a presumed density of the dyestuff of about $d = 1$ g/cm$^3$, corresponding to layer thicknesses from about 0.001 to about 0.15 $\mu$m or from about 0.03 to about 0.1 $\mu$m or from about 0.05 to about 0.12 $\mu$m. (The densities of the dyestuffs are somewhat higher, which means correspondingly smaller layer thicknesses.)

Although two successive vapor depositions are necessary, this method permits a particularly good reproducible production of a very thin charge carrier production layer. This method of the layer arrangement thus is very suitable. The layerwise arrangement of the dyestuffs corresponds to the penetration depth of the light and to the excitability of the thin dyestuff layers at different wave lengths.

According to the described methods, uniform, tightly packed dyestuff layers can be produced, in which the dyestuffs are present either as a mixed phase or in a multi-layer phase. The organic covering layer arranged above is sufficiently transparent so that these dyestuffs can be excited optimally.

According to the invention, those pigment dyestuffs are suitable which have a high thermal stability so that they can be vapor-deposited under the given vapor deposition conditions ($10^{-3}$ to $10^{-5}$ mm Hg, 150° to 400° C) without decomposition, optionally also continuously. The pigment dyes also must have such a high photomechanical stability that they can repeatedly sustain the exposure conditions in copying devices.

Advantageously, their preparation and purification also should be simple. Furthermore, they should not be dissolved during subsequent coating with the solution of the covering layer.

The pigment dyes also should have a certain stability in concentrated sulfuric acid so that they are accessible to photometric determination.

Yellow, orange or red pigment dyes which substantially meet these requirements, and thus are suitable in accordance with the invention, and can be employed together with a phthalocyanine dyestuff — Formula 7 — for increasing the light-sensitivity into the red spectral region are, for example:

Perylene-3,4,9,10-tetracarboxylic acid derivatives — Formula 1 — with R standing for hydrogen, alkyl with 1 to 4 carbon atoms, optionally substituted aryl, aralkyl, or a heterocyclic radical or —NH—R' with optionally substituted phenyl or benzoyl, according to German Offenlegungsschrift No. 2,237,539.

Quinacridones — Formula 2 — with R standing for hydrogen, alkyl with 1 to 4 carbon atoms, alkoxy with 1 to 4 carbon atoms, halogen, nitro groups, hydroxyl or a condensed aromatic ring system, according to German Offenlegungsschrift No. 2,237,679, polynuclear quinones — Formulae 3 and 4 — with *y* standing for hydrogen, alkoxy, or halogen, according to German Offenlegungsschrift No. 2,237,678.

Perinones or naphtholylene-naphthimidazole-(1',-2')-peridicarboxylic acid derivatives — Formulae 5 and 6 — with R standing for hydrogen, lower alkyl or phenyl, according to German Offenlegungsschrift No. 2,239,923. Thioindigo dyestuffs, e.g. according to Formula 8 — according to German Offenlegungsschrift No. 2,237,680.

Condensation products from benzo-4,10-thioxanthene-3,1'-dicarboxylic acid anhydride and amines — Formula 9 — with R standing for hydrogen, alkyl with 1 to 4 carbon atoms, alkoxyalkyl with 3 to 8 carbon atoms, optionally substituted aryl or an N-heterocyclic radical, according to German Offenlegungsschrift No. 2,246,255.

According to the invention, these pigment dyes are used alone or in admixture with phthalocyanine dyestuffs according to Formula 7.

Pigment dye combinations in the mixed phase or in multi-layer phase have proved particularly suitable, such as N,N'-dimethylperylene-3,4,9,10-tetracarboxylic acid diimide — Formula 1, Colour Index 71,130, and metal-free phthalocyanine — Formula 7, Colour Index 74,100 — as well as flavanthrene, Colour Index 70,600, and metal-free phthalocyanine. It has been found that metal-containing phthalocyanine compounds, e.g. copper phthalocyanines, such as Cromophthalblau 4 G of Ciba Geigy, Colour Index 74,160, are suitable.

The mixing ratio of the dyestuffs may vary within wide limits, but it has been found that a markedly improved sensitivity to red light can be achieved with a phthalocyanine portion up to about 15 per cent by weight, calculated on the total dyestuff. In some cases, greater portions of phthalocyanine can be used, as it is shown, for example, in admixture with dyestuffs of the group of the quinacridones — Formula 2.

Figure 8:
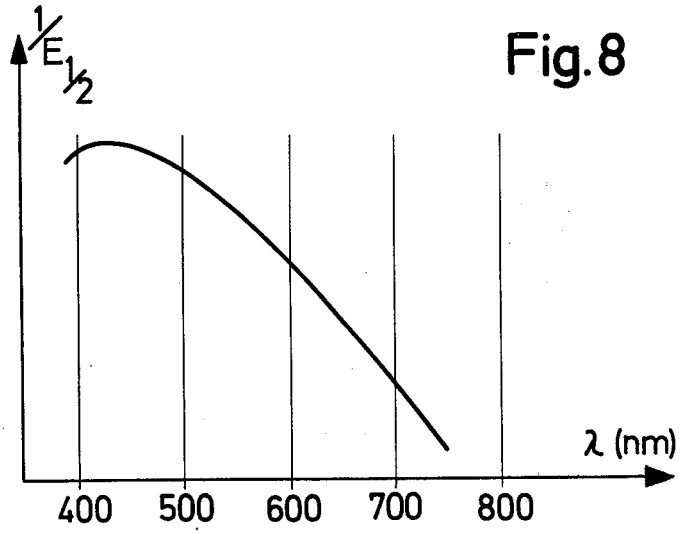
FIG. 8 shows the light-sensitivity curves of a photoconductor layer having a sensitivity towards the region of relatively short waves.

The variation of phthalocyanine dyestuffs with at least one yellow, orange or red dyestuff permits the production of a series of further dyestuff layers of a specific spectral distribution, in particular by a specific doping of the charge carrier production layer its spectral region can be adapted to the lamp type used in the copying device. For the use of conventional halogen-tungsten lamps, parallel to the increasing emission of this lamp in the red spectral region, a photoconductor layer is advantageous which has a sensitivity towards the region of relatively short waves, as is diagrammatically shown in FIG. 8.

Highly sensitive photoconductor layers can be produced by the application of an insulating, organic covering layer to the dyestuff arrangement.

The covering layer has a high resistance and prevents the dissipation in the dark of the electrostatic charge.

Upon exposure, it transports the charges produced in the dyestuff layer. The covering layer preferably is transparent, but a covering layer which is not transparent is also possible, e.g. in the case of transparent conductive carrier material.

The covering layer acts as a charge carrier transport layer and, without the dyestuff layer, has a substantially lower photosensitivity in the visible region of 420 to 750 nm.

In the case of a negative charge, the covering layer preferably is composed of a mixture of an electron donor compound and a resin binder. When the electrophotographic recording material of the invention is to be used for a positive charge, the transparent covering layer preferably is composed of a mixture of an electron acceptor compound and a resin binder.

Suitable materials for charge transport are especially those organic compounds which have an expanded $\pi$-electron system, particularly monomeric and polymeric aromatic or heterocyclic compounds.

Monomers employed are those which have at least one dialkylamino group. Particularly useful are heterocyclic compounds, such as oxdiazole derivatives, which are mentioned in German Patent Specification No. 1,058,836. An example thereof is, in particular, the 2,5-bis-(4'-diethylaminophenyl)-oxdiazole-1,3,4. Further suitable monomeric electron donor compounds are, for example, triphenylamine derivatives, highly condensed aromatic compounds, such as anthracene, benzocondensed heterocycles, pyrazoline or imidazole derivatives, as well as triazole and oxazole derivatives, as disclosed in German Patents Nos. 1,060,260 and 1,120,875.

Suitable polymers are, for example, vinylaromatic polymers, such as polyvinyl anthracene, polyacenaphthylene or copolymers. Poly-N-vinylcarbazole or copolymers of the N-vinylcarbazole with an N-vinylcarbazole content of at least about 40 per cent have proved suitable. Also suitable are formaldehyde condensation products with various aromatics, e.g. condensates from formaldehyde and 3-bromopyrene.

Besides these mentioned compounds having predominantly a p-conductive character, it is also possible to use n-conductive compounds. These so-called electron acceptors are known from German Patent No. 1,127,218, for example. Compounds such as 2,4,7-trinitrofluorenone or 3,6-dinitro-N-t-butylnaphthalimide have proved particularly suitable.

These charge transport compounds are used in connection with conventional additives, such as resin binders or adhesion promotors, which correspond to the compound for charge transport as regards charge transport, film property, adhesion promotion, and surface characteristics. Finally, other conventional additives, such as levelling agents, plasticizers, and adhesives may also be present.

Suitable resin binders with regard to flexibility, film properties and adhesion are natural or synthetic resins. Examples thereof are in particular polyester resins, e.g. those marketed under the names Dynapol (Dynamit Nobel), Vitel PE 200 (Goodyear), and which are copolyesters of iso- and terephthalic acid with glycol. Silicone resins, as those known under the name Silikonharz SR of General Electric Company, or Dow 840 of Dow Corning Corporation, and representing threedimensionally cross-linked phenyl-methyl-siloxanes or so-called reactive resins, as those known as DD lacquers and composed of an equivalent mixture of Desmophen and Desmodur of Bayer AG, Leverkusen, Germany, have proved suitable. Furthermore, copolymers of styrene and maleic acid anhydride, e.g. those known under the name Lytron (Monsanto Chemical Company), and also polycarbonate resins, e.g. those known under the name Lexan Grade of General Electric Company are suitable for use. Solutions of polyester urethane prepolymers which are after-cross-linkable also may be employed successfully (e.g. Daltosec types of ICI), furthermore acrylate resins containing hydroxyl groups (e.g. Macrynal types of Cassella Farbwerke Mainkur AG) which can be after-cured with compounds containing isocyanate groups (Desmodur types) or melamine resins.

The mixing ratio of charge transporting compound to resin binder may vary. Fairly specific limits are imposed, however, by the requirement for maximum photosensitivity, i.e. for the greatest possible portion of charge-transporting compound, and for crystallization to be avoided, i.e. for the greatest possible portion of resin binders. A mixing ratio of about 1 : 1 part by weight has proved preferable, but ratios from about 3 : 1 to 1 : 4 or above are suitable, depending on the particular case.

In addition to the requirement that the covering layer be transparent, the thickness of the layer is also an important parameter for optimum photosensitivity; layer thicknesses between about 5 and about 30 $\mu$m are preferred. It has been found that the thickness ranges vary when monomeric or polymeric charge transporting compounds are used in binders. The ranges for monomeric compounds thus are towards greater thickness (7 to 30 $\mu$m), whereas for polymeric charge transporting compounds thicknesses in the range from about 4 to 20 $\mu$m are sufficient. Quite generally, a lower maximum charge level must be expected at layer thicknesses below about 5 $\mu$m.

The optional addition of adhesives or plasticizers, particularly to polymeric charge-transporting compounds barely diminishes the good photosensitivity when suitable materials are used. Chlorinated paraffins, e.g. Hordaflex LC types, Hoechst AG; chlorinated diphenyl resins, e.g. Clophen W (Bayer) have proved particularly suitable. In the described manner, the covering layers have the property to render possible a high charge with a small dark discharge. Whereas in all conventional sensitizations an increase of the photosensitivity is connected with an increase of the dark current, this parallelity can be prevented here. The layers thus can be used in electrophotographic copying devices with low copying speeds and very small lamp energies as well as in those with high copying speeds and correspondingly higher lamp outputs. Due to their panchromatic sensitivity range, photoconducting systems with the dyestuffs of the invention are particularly suitable for use in color copying devices.

Furthermore, it has proved particularly suitable with this layer arrangement that, despite the unavoidable abrasion of the covering layer during copying, the photoconductive double layer system is not substantially impaired. The chargeability decreases to a small extent but, due to the thickness decrease, the photosensitivity increases slightly.

The invention will be further illustrated by reference to the following examples:

EXAMPLE 1

This example shows the basic points of prior art and describes the experimental methods to be employed.

The pigment dyes N,N'-dimethylperylene-3,4,9,10-tetracarboxylic acid diimide (Formula 1, R = $CH_3$) and metal-free phthalocyanine (Formula 7) are vapor-deposited in a vacuum vapor-deposition apparatus at $10^{-4}$ to $10^{-5}$ mm Hg in one case within 2 minutes at about 280° C and in the other case within 1 to 2 minutes at about 320° C onto 100 $\mu$m thick aluminum foils arranged at a distance of 15 and 25 cm, respectively, the vapor-deposition temperatures being measured directly on the surface of the dyestuffs to be vapor-deposited. The vapor-deposited layers are homogeneous and completely cover the carrier material. The gravimetrically determined dyestuff weights are in the range between 10 and 200 mg/m$^2$.

The effective spectral regions of the vapor-deposited layers are determined by means of reflectance measurements. For this purpose, the dyestuff is vapor-deposited at a dyestuff layer weight of 80 to 100 mg/m$^2$ onto a polyester film with a vapor-deposited aluminum layer of about 200 mg/m$^2$, the reflectance of the film being in the range between 350 and 750 nm at 85 to 80 per cent. The reflectance measurements of the dyestuff layers as well as of the polyester film vapor-deposited with aluminum are performed in a DMR 21 spectrophotometer of Messrs. Zeiss with a reflectance attachment ZR 21 (Ulbricht sphere-type photometer).

FIG. 4 shows the reflectance curves for N,N'-dimethylperylene-3,4,9,10-tetracarboxylic acid diimide (Curve 1) as well as for phthalocyanine (Curve 2).

Onto the initially described vapor-deposited layers, there is whirl-coated a solution of equal parts by weight of 2,5-bis-(4'-di-ethylaminophenyl)-oxdiazole-1,3,4 (melting point 149° to 150° C) and polyester resin, e.g. Dynapol L 206 of Dynamit Nobel, in tetrahydrofuran. After drying, a covering layer thickness of about 10 $\mu$m is obtained. The measurement of the photosensitivity or the characterization of the photoconductive double layers is performed as follows:

a. In a Dyn-Test 90 instrument of ECE, Giessen, Germany, the measuring sample is fixed onto a rotating disc ($n$ = 1,350 rpm) where it is intermittently charged (corona width 20 mm) and exposed to light (filament lamp; 6.0 V, 0.6 W; T = 2,800 K). A measuring probe registers the charge or the voltage decay, which is recorded by means of a recorder.

Figure 9:
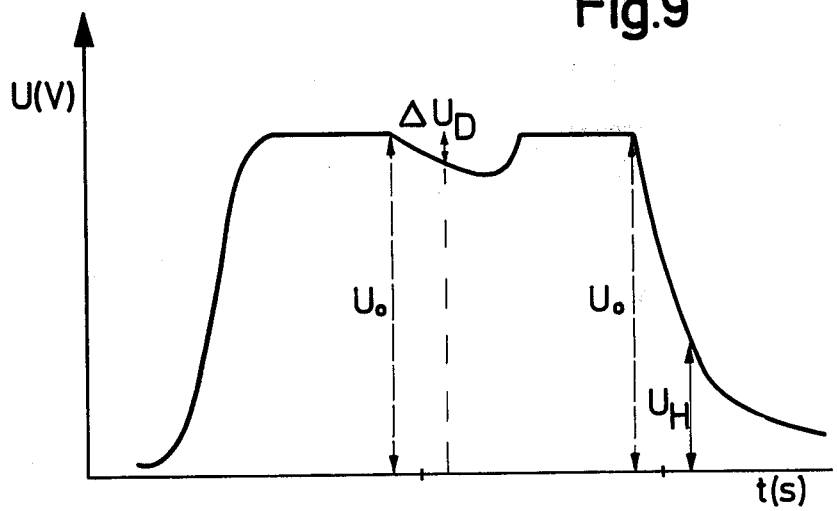
FIG. 9 shows, for a photoconductor layer, the maximum charge, the potential decay in the dark after two seconds, and the potential achieved after exposure for two seconds with the use of a gray filter, and Formulae 1 to 9 show various dyestuffs.

For the characterization of the photoconductor layer, the maximum charge ($U_o$), the potential decay ($\Delta U_D$) in the dark after 2 seconds and the potential ($U_H$) achieved after exposure for 2 seconds with the use of a gray filter of a transmission of 7.5 per cent are determined. The values are diagrammatically shown in FIG. 9.

For comparison of the light-sensitivities of the layers, the ratio $f$ is formed according to the following equation:

$$f = \frac{U_H + \Delta U_D}{U_o}$$

which yields a lower light-sensitivity with a higher value.

With the use of the standard color filters of ECE, the individual sensitivity for the various wavelength regions can be determined by the factor $f$ (color filter).

The following values are obtained:

| Dyestuff | f | | | | | $U_o$(V) |
|---|---|---|---|---|---|---|
| No. | gray | blue | green | yellow | red | (negative) |
| 1 | 0.89 | 0.30 | 0.34 | 0.26 | 0.92 | 1,400 |
| 7 | 0.58 | 0.70 | 0.61 | 0.23 | 0.23 | 1,120 |

The dark decay $\Delta U_D$ of these layers within 2 seconds is in the range between 100 and 200 V.

b. In another apparatus, the measuring sample is continuously exposed to xenon light. The photoconductor layer moves on a rotating plate through a charging device to the exposure station, where it is continuously exposed to an XBO 150 xenon lamp of Osram. A KG 3 heat absorption glass of Schott & Gen., Mainz, and a neutral filter of 15% transparency are placed in front of the lamp. The light intensity in the plane of measurement is about 270 $\mu$W/cm$^2$. The charge level ($U_o$) and the photo-induced light decay curve are recorded oscillographically by means of a 610 CR electrometer of Keithley Instruments, U.S.A., through a transparent probe. The photoconductive layer has the charge level ($U_o$) and the time ($T_{1/2}$) after which half the charge ($U_o/2$) is reached. The determination of the spectral light-sensitivity according to this method is performed with the use of filters:

Using a negative charge, the half-life ($T_{1/2}$ msec) for the particular wavelength range is determined by exposure. The spectral light-sensitivity is obtained by plotting the reciprocal values of the product of half-life ($T_{1/2}$ in seconds) and the light intensity ($\mu$W/cm$^2$) against the wavelength $\lambda$ (nm). The reciprocal value of $T_{1/2}$. I ($1/E_{1/2}$) denotes the light energy per unit area which must be incident to discharge the layer to half the initial potential $U_o$.

Figure 5:
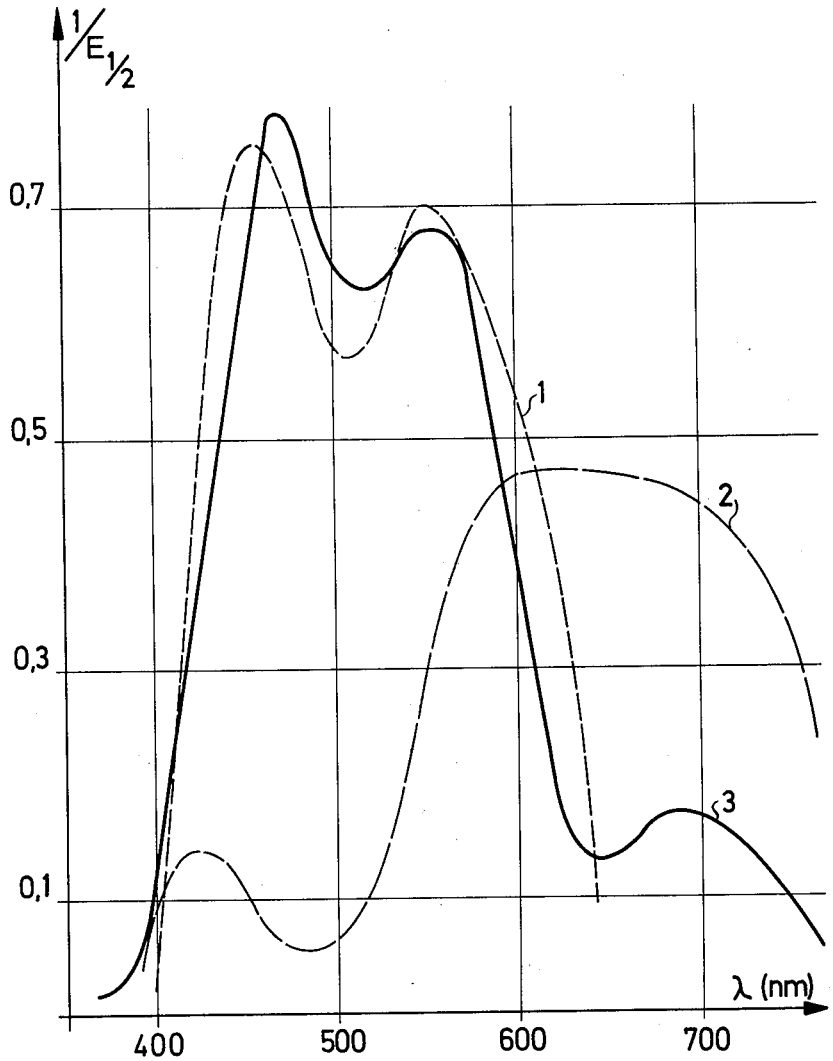
FIG. 5 shows the light-sensitivity curves of two dyestuffs.

FIG. 5 shows the curves of the spectral light-sensitivity for the red dyestuff (Curve 1) as well as for the blue dyestuff (Curve 2).

EXAMPLE 2

Under the vapor-deposition conditions described in Example 1, a mixture of 97 parts by weight of N,N'-dimethylperylene-3,4,9,10-tetracarboxylic acid diimide and 3 parts by weight of phthalocyanine (Monolite Fast Blue GS, ICI), is vapor-deposited within 2 minutes at 300° C onto a 100 $\mu$m thick aluminum foil and a homogeneous mixed-dye layer with a good covering power is obtained. The dyestuff layer weight is at about 100 mg/m$^2$.

The test of the dyestuff portions in these vapor-deposited layers is performed photometrically after separation of the vapor-deposited pigments with concentrated sulfuric acid.

For establishing the calibration curves (extinction plotted against the pigment concentration) for N,N'-dimethylperylene-3,4,9,10-tetracarboxylic acid diimide at 590 nm for phthalocyanine at 840 nm, the absorption of the dyestuff mixtures in relation to concentrated sulfuric acid is measured and recorded by means of a Beckmann photometer DK 2 in the region of 1,000 to 500 nm. The ratio by weight in the vapor-deposited layer is 97 : 3.

For establishing the reflectance curve of a vapor-deposited layer with N,N'-dimethylperylene-3,4,9,10-tetracarboxylic acid diimide and metal-free phthalocyanine at a ratio of 97 : 3, vapor deposition is carried out in connection with the data in Example 1 under the same conditions so that the mixing ratio is maintained and the layer thickness is about 80 to 100 mg/m². The resulting reflectance curve is shown as Curve 3 in FIG. 4.

The initially described mixed vapor-deposited layer is coated with a solution of equal parts by weight of 2,5-bis(4'-diethylaminophenyl)-oxdiazole-1,3,4 and polyester resin, e.g. Dynapol L 206, which has a layer thickness of 10 to 12 μm after drying.

The photosensitivity or light-sensitivity with different color filters is measured by means of the Dyn-Test 90 instrument stated under 1*a*. The following values are obtained:

| | | |
|---|---|---|
| f gray | : | 0.70 |
| f red | : | 0.32 |
| $U_o$(V) | : | −1,300 |
| Δ $U_D$(V) | : | 170 |

The spectral light-sensitivity of this layer system is determined as described in Example 1*b*. The resulting curve is shown by numeral 3, in FIG. 5.

EXAMPLE 3

Dyestuff layers from N,N'-dimethylperylene-3,4,9,10-tetracarboxylic acid diimide and phthalocyanine at different mixing ratios are produced under the described vapor deposition conditions within 2 to 3 minutes at about 300° C on 100 μm thick aluminum foil. The composition of the homogeneous dyestuff layers is determined according to the photometric method described in Example 2. The dyestuff layers with different phthalocyanine contents are provided with covering layers by whirl-coating a solution of equal parts by weight of 2,5-bis(4'-diethylaminophenyl)-oxdiazole-1,3,4 and polyester resin as well as 5 per cent, calculated on the solids content, of 3,5-dinitro-benzoic acid and drying in a thickness of 10 to 12 μm.

Drying is performed within 5 minutes at 110° C in a circulating-air dryer. Homogeneous, glossy films are obtained the photosensitivity of which is characterized according to Example 1*a*.

| Mixture of the dyestuffs Nos. 1 and 7 | f gray | $U_o$(V) negative | $\Delta U_D$ (V) |
|---|---|---|---|
| 99/1 | 0.81 | 1,075 | 25 |
| 96/4 | 0.61 | 950 | 150 |
| 92/8 | 0.53 | 850 | 200 |
| 85/15 | 0.41 | 800 | 275 |

EXAMPLE 4

With the dyestuff combination quinacridone (Formula 2, R = H), e.g. Cinquasia Red B, DuPont, C.I. 46,500, and phthalocyanine, e.g. Monolite Fast Blue G 5, ICI, C.I. 74,100, vapor-deposited layers are produced at different mixing ratios by vapor-depositing the dyestuff or the dyestuff mixtures at about 300° C within 2 minutes.

The portions of the dyestuffs are determined photometrically after separation in concentrated sulfuric acid, the absorption band at $\lambda_{max}$ = 600 nm being used for determining the quinacridone content and for determining the calibration curve.

After coating with a solution from equal parts by weight of 2,5-bis-(4'-diethylaminophenyl)-oxdiazole-1,3,4 and polyester resin in a thickness of 10 to 12 μm (dried), the following values are determined according to Example 1*a*.

| Mixture of the dyestuffs Nos. 2 and 7 | f gray | f red | $U_o$(V) negative | $\Delta U_D$ (V) |
|---|---|---|---|---|
| 100/– | 0.94 | 0.98 | 1,240 | 60 |
| 93/7 | 0.89 | 0.35 | 850 | 40 |
| 83/17 | 0.82 | 0.33 | 825 | 60 |
| 76/24 | 0.62 | 0.24 | 785 | 40 |

EXAMPLE 5

In this example the different dyestuffs are arranged in the vapor-deposited layer in two thin, adjacent layers, as shown in FIG. 2. This is achieved by successively vapor-depositing the pigment dyes in the vacuum, that dyestuff being vapor-deposited first or in contact with the conductive carrier which extends the photosensitivity into the red spectral region or the spectral region of relatively long waves.

Phthalocyanine, e.g. Monolite Fast Blue GS, ICI, is vapor-deposited at about 320° C within 1 minute under the conditions of Example 1 onto a 100 μm thick aluminum foil. The layer thickness is about 50 mg/m² with this short vapor deposition time. N,N'-dimethylperylene-3,4,9,10-tetracarboxylic acid diimide is vapor-deposited onto this homogeneous, blue layer in a second vapor deposition step at 280° C within 1.5 minutes. The layer thickness is about 80 mg/m².

A covering layer from a tetrahydrofuran solution of equal parts by weight of 2,5-bis(4'-diethylaminophenyl)-oxdiazole-1,3,4 and polyester resin is applied thereto so that the thickness is 10 to 12 μm after drying. The photosensitivity of this multi-ply photoconductor layer is determined according to Example 1*a*.

| | |
|---|---|
| f: gray | 0.75 |
| blue | 0.28 |
| green | 0.30 |
| yellow | 0.21 |
| red | 0.35 |
| Charge level $U_o$ | −1,090 V |
| Dark decay $\Delta U_D$ | 150 V |

Figure 6:
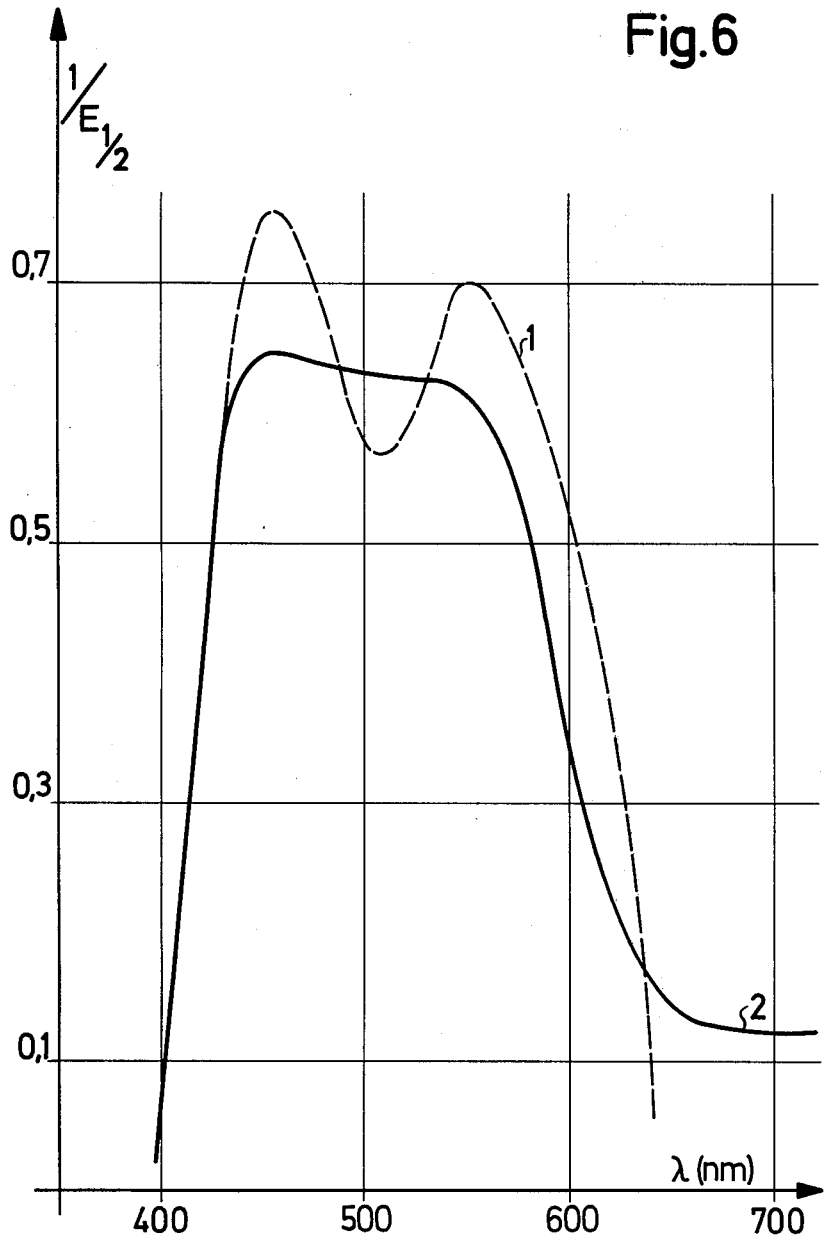
FIG. 6 shows the light-sensitivity curves of a multi-ply photoconductor layer.

Furthermore, the spectral light-sensitivity is determined as stated in Example 1*b* (xenon light, XBO 150 lamp, light-intensity I~499 μW/cm²). This results in Curve 2 of FIG. 6 to which, for comparison purposes, Curve 1 of FIG. 5 for N,N'-dimethylperylene-3,4,9,10-tetracarboxylic acid diimide is attached.

EXAMPLE 6

With the dyestuff combination cis-perinone — Formula 5, R = H—, e.g. Permanentrot TG 01 of Hoechst AG, CI 71,100, and phthalocyanine, e.g. Monolite Fast Blue GS, ICI, CI 74,100, vapor deposited layers are produced at different mixing ratios by vapor-depositing the dyestuffs or mixtures at about 290° to 300° C within 1.5 minutes:

| | | |
|---|---|---|
| a) | cis-perinone | 100/– |
| b) | cis-perinone/phthalocyanine | 98.5/1.5 |
| c) | cis-perinone/phthalocyanine | 93.5/6.5 |

The dyestuff coating is 60 to 90 mg/m². The dyestuff composition is determined as described in Example 2. The wavelength for cis-perinone is 480 nm.

A solution of equal parts by weight of 2,5-bis-(4'-diethylaminophenyl)-oxdiazole-1,3,4 and polyester resin is whirl-coated onto these vapor-deposited dyestuff layers so that the thickness of the dried covering layers is about 10 μm. The determination of the photosensitivity is performed by means of a Dyn-Test 90 instrument and yields the following *f*-values:

| Layer | gray | blue | green | yellow | red |
|---|---|---|---|---|---|
| a | 0.94 | 0.42 | 0.61 | 0.20 | 0.93 |
| b | 0.77 | 0.45 | 0.51 | 0.17 | 0.38 |
| c | 0.57 | 0.43 | 0.43 | 0.28 | 0.27 |

The charge level of these layers is between 1,100 and 1,400 V; the dark decay $\Delta U_D$ after 2 seconds is between 40 and 180 V.

EXAMPLE 7

A solution of equal parts by weight of 2-phenyl-4-(2'-chloro-phenyl)-5(4'-diethylaminophenyl)-oxazole-1,3 and polyester resin is whirl-coated onto dyestuff layers *a* of Example 1 — Formula 1 — and *b* of Example 2, which, after drying, have a layer thickness of about 10 μm.

The following values are determined according to Example 1*a:*

| Layer | f(gray) | f(red) | $(-)U_n$(V) | $\Delta U_D$ |
|---|---|---|---|---|
| a | 0.93 | 0.94 | 910 | 100 |
| b | 0.63 | 0.31 | 760 | 140 |

EXAMPLE 8

Onto a 100 μm thick aluminum foil, there are vapor-deposited a first dyestuff layer of copper phthalocyanine — according to Formula 7 — e.g. Cromophthalblau 4 G, Ciba AG, in a thickness of about 0.07 μm and, thereupon, a second dyestuff layer of N,N'-dimethylperylene-3,4,9,10-tetracarboxylic acid diimide — Formula 1, R = $CH_3$ — in a thickness of about 0.6 μm.

The successively vapor-deposited dyestuff layers are provided with a covering layer as indicated in Example 2. Measurement of the sensitivity, particularly in the red spectral region, according to Example 1*a*, yields an *f*-value of 0.57 with red filter and a negative charge $U_o$ of 960 V.

EXAMPLE 9

A dyestuff combination of 90 parts by weight of 4,10-diiodobenzo-(def, mno)-chrysene-6,12-dione according to Formula 3, e.g. Indanthrene Scarlet FR, and 10 parts by weight of phthalocyanine of Example 7 is vapor-deposited at $10^{-4}$ mm Hg and 340° C within 3 minutes onto a 100 μm thick aluminum foil. The dyestuff layer is provided with a covering layer according to Example 2.

For comparison purposes, a recording material is produced with a dyestuff layer from the mentioned dyestuff according to Formula 3. The results of measurement according to Example 1*a* are compiled in the following table:

| Dyestuff No. | f gray | f red | $-U_n$(V) | $\Delta U_D$ |
|---|---|---|---|---|
| 3 and 7 | 0.64 | 0.24 | 1,200 | 190 |
| 3 | 0.77 | 0.97 | 1,220 | 90 |

EXAMPLE 10

A recording material as described in Example 5 is provided, prior to vapor deposition, with an adhesive intermediate layer (FIG. 3, position 5) from polyamide resin solution, e.g. Elvamide 8061 of DuPont, in a thickness of about 0.2 μm. The values determined according to Example 1*a* are

| | | |
|---|---|---|
| f | gray | 0.76 |
| | red | 0.51 |
| negative charge $U_n$ | | 1,010 V |

EXAMPLE 11

Dyestuff layers from flavanthrene — Formula 4 — e.g.

a. Cromophthalgelb A2R, CI 70,600, of Ciba-Geigy AG, or b. phthalocyanine — Formula 7 — and a) at different mixing ratios are produced by vapor deposition in the vacuum according to the conditions of Example 1 on aluminum foil. The dyestuff mixtures are vapor-deposited within 2 minutes at a temperature of 300° to 330° C in a thickness of 60 to 80 mg/m². The composition of the vapor-deposited dyestuff mixtures, by analogy to Example 2, is determined photometrically in concentrated sulfuric acid. The calibration curve for the determination of the Cromophthalgelb A2R content is established at a wavelength of 510 nm.

To these homogeneous dyestuff layers, there is applied an about 10 μm thick covering layer of 2,5-bis(4'-diethylaminophenyl)-oxdiazole)-1,3,4 and polyester resin.

The photosensitivity of these double layers is determined by analogy to Example 1*b*. The curves of the spectral light-sensitivity are shown in FIG. 7 (xenon light, XBO 150 lamp, I~270 μW/cm²)

| Layer with dyestuff No. | Ratio by weight | T½ (msec) | $U_o$(V) negative | $\Delta U_D$ (V) |
|---|---|---|---|---|
| 4 | 100 | 12 | 910 | 120 |
| 4 and 7 | 97.5/2.5 | 18 | 925 | 55 |
| 4 and 7 | 38/62 | 16 | 900 | 160 |

Figure 7:
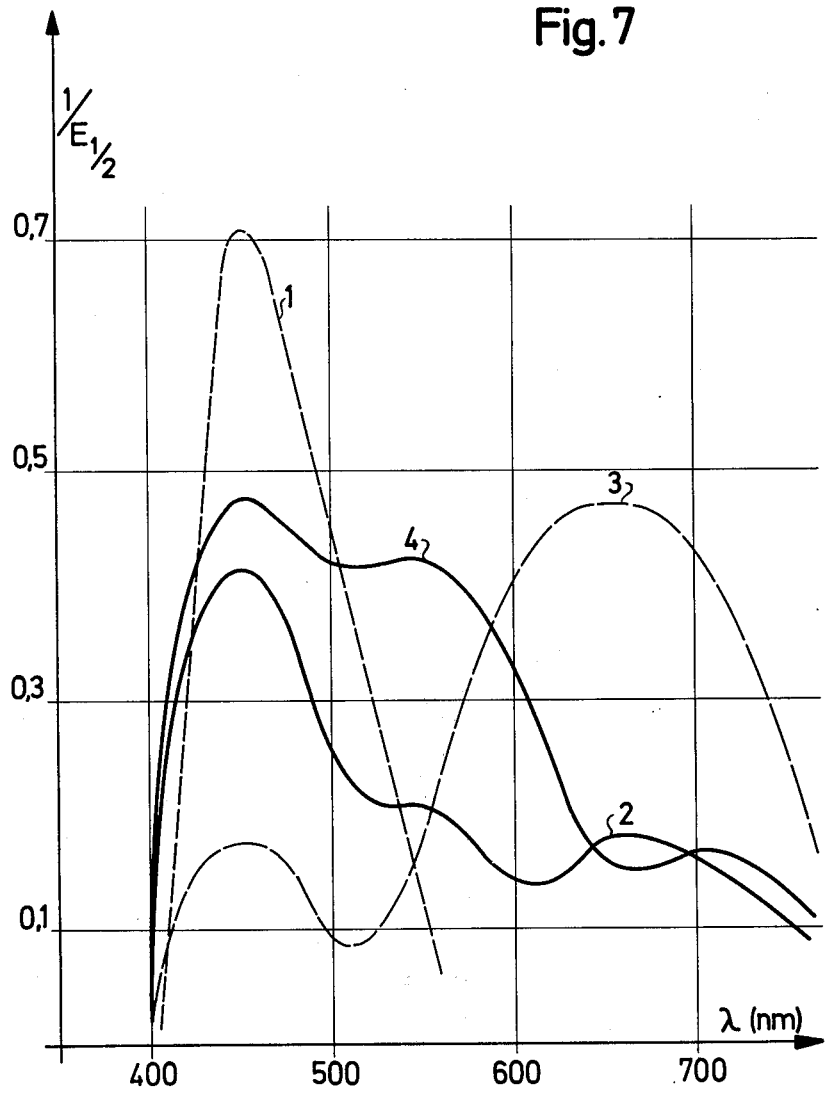
FIG. 7 shows the light-sensitivity curves of additional dyestuffs.

The resulting curves are shown in FIG. 7 for Dyestuff 4 (Curve 1), for Dyestuff 7 (Curve 3) and for the mixture 97.5/2.5 (Curve 2).

EXAMPLE 12

By analogy to the pigment-dyestuff combination flavanthrene and phthalocyanine of Example 11, a mixture is produced with the pigment dye according to Formula 1 so that a mixed phase of the following composition is vapor-deposited onto an aluminum support according to the conditions indicated:

| | | |
|---|---|---|
| 87.5 | per cent by weight | of N,N'-dimethylperylene-3,4,9,10-tetracarboxylic acid diimide, |
| 10.0 | per cent by weight | of flavanthrene, |
| 2.5 | per cent by weight | of phthalocyanine |

An insulating, organic covering layer is applied to this homogeneous vapor-deposited dyestuff layer as in Example 11 under the conditions indicated there.

At a negative charge of $U_o = 975$ V, a half-life of $T_{1/2} = 12$ msec and a dark decay after 2 seconds of $\Delta U_D = 140$ V is measured at a light-intensity of I~437 $\mu W/cm^2$.

The spectral light-sensitivity is shown as Curve 4 in FIG. 7.

EXAMPLE 13 a. A vapor-deposited dyestuff layer produced by analogy to Example 2 and composed of 97 parts by weight of N,N'-dimethylperylene-3,4,9,10-tetracarboxylic acid diimide and 3 parts by weight of phthalocyanine is coated with a solution of equal parts by weight of 2,4,7-trinitrofluorenone-9 and polyester resin, e.g. Dynapol L 206 of Dynamit Nobel, in a thickness of about 8 to 10 $\mu$m (after drying).

b. For comparison of the spectral sensitization, a vapor-deposited layer of N,N'-dimethylperylene-3,4,9,10-tetracarboxylic acid diimide is provided under the same conditions with the covering layer according to *a*. The increase of the sensitivity in the red spectral region is proved by the *f*-values determined by means of the Dyn-Test instrument according to Example 1*a*, the measurement being performed at a positive charge:

| Layer | (+) $U_o$(V) | f (red) | $\Delta U_D$ |
|---|---|---|---|
| a | 510 | 0.60 | 140 |
| b | 980 | 0.99 | 190 |

EXAMPLE 14

An about 100 mg/cm² thick vapor-deposited layer of phthalocyanine — Formula 7 — is produced on a polyester film laminated with aluminum according to the vapor deposition conditions of Example 1.

Red dyestuffs of the following constitutions are gently vapor-deposited thereonto in a thickness range from 50 to 100 mg/m²:

a. naphthoylene-naphthimidazole(1',2')-peridicarboxylic acid imide — Formula 6, R = $CH_3$ — b. Indanthrene Brilliant Pink R, CI 73,360 — Formula 8 —, and c. a condensation product from 4,10-benzo-thioxanthrene-3,1'-dicarboxylic acid anhydride and methyl amine — Formula 9.

For proving the extension into the spectral region of relatively long waves, furthermore, the red dyestuff layers are produced alone under the same conditions on the carrier material. A phthalocyanine comparison layer is also measured. The production of multi-ply layers by applying the covering layer concerned is performed as indicated in Example 1 in a thickness of about 8 to 10 $\mu$m.

The sensitivity in the region of 453 to 710 nm is determined oscillographically by using monochromatic filters according to the method described in Example 1*b*. The light-intensity of the xenon lamp XBO 150 is 530 $\mu W/cm^2$ with a gray filter of 15%.

For the individual line filters (half-value bandwidth 10 to 12 nm) there are measured the intensities stated in this table:

| Layers with dyestuff No. | (−)$U_o$ V | $T_{1/2}$ (msec) 453 | 505 | 552 | at 606 | 650 | (nm) 707 |
|---|---|---|---|---|---|---|---|
| 7 | 725 | 670 | 460 | 130 | 105 | 145 | 140 |
| 6 | 1,150 | 170 | 80 | 95 | 205 | — | — |
| 7 and 6 | 975 | 135 | 65 | 85 | 140 | 235 | 315 |
| 8 | 1,150 | 630 | 175 | 175 | — | — | — |
| 7 and 8 | 1,075 | 510 | 150 | 155 | 360 | 500 | 670 |
| 9 | 1,150 | 490 | 200 | 595 | — | — | — |
| 7 and 9 | 1,000 | 565 | 440 | 530 | 270 | 350 | 475 |
| Light-intensity | | 54 | 84 | 80 | 70 | 45 | 40 |

It will be obvious to those skilled in the art that many modifications may be made within the scope of the present invention without departing from the spirit thereof, and the invention includes all such modifications.

What is claimed is:

1. Electrophotographic recording material comprising an electrically conductive carrier material having thereon a photoconductive multi-layer system of at least one charge carrier producing dyestuff layer of organic material and an insulating, organic, covering layer thereon with at least one charge carrier transporting compound, said dyestuff layer comprising at least two pigment dyes absorbing in different spectral regions of the visible spectrum of about 420 to about 750 nm, at least one dye absorbing in the region of relatively long waves and at least one dye absorbing in the region of relatively short waves, the pigment dye absorbing in the region of relatively long waves being a phthalocyanine dye compound.

2. Recording material according to claim 1 including an intermediate adhesive layer on said carrier material.

3. Recording material according to claim 1 in which said covering layer is transparent.

4. Recording material according to claim 1 in which the pigment dye absorbing in the region of relatively long waves is a metal-free phthalocyanine.

5. Recording material according to claim 1 in which the content of pigment dye absorbing in the region of relatively long waves, calculated on the total dyestuff weight, is about 0.5 to about 40 percent by weight.

6. Recording material according to claim 1 in which the pigment dyes are present in one layer.

7. Recording material according to claim 6 in which the pigment dye absorbing in the region of relatively short waves is N,N'-dimethylperylene-3,4,9,10-tetracarboxylic acid diimide and the pigment dye absorbing in the region of relatively long waves is a phthalocyanine, said dyes being present in a weight ratio of 99.5 to 94 : 0.5 to 6.

8. Recording material according to claim 1 in which the pigment dyes are present layerwise.

9. Recording material according to claim 8 in which the pigment dye absorbing in the region of relatively short waves is flavanthrene and the pigment dye absorbing in the region of relatively long waves is a phthalocyanine, said dyes being present in a weight ratio of 97.5 : 2.5.

10. Recording material according to claim 1 in which the layers of the pigment dyes are arranged one upon the other, the dye absorbing in the region of relatively long waves being closer to the carrier than the dye absorbing in the region of relatively short waves.

11. Recording material according to claim 1 in which the pigment dye layer has a thickness of about 0.005 to about 2 $\mu$m.

12. Recording material according to claim 1 in which the pigment dye layers have a thickness of about 0.001 to about 0.15 $\mu$m.

13. Recording material according to claim 1 in which the pigment dye absorbing in the region of relatively short waves is N,N'-dimethylperylene-3,4,9,10-tetracarboxylic acid diimide, CI 71,130.

14. Recording material according to claim 1 in which the pigment dye absorbing in the region of relatively short waves is flavanthrene CI 70,600.

15. Recording material according to claim 1 in which the dyestuff layer has a photosensitivity increasing from the region of relatively long waves to the region of relatively short waves.

16. Electrophotographic recording material according to claim 1 in which the pigment dye absorbing in the region of relatively short waves is selected from the group consisting of perylene-3,4,9,10-tetracarboxylic acid derivatives, quinacridones, perinones, naphtholylene-naphthimidazole-(1',2')-peridicarboxylic acid derivatives, thioindigo and condensation products from benzo-4,10-thioxanthene-3,1'-dicarboxylic acid anhydride and amines.

17. Electrophotographic recording material according to claim 1 in which the pigment dye absorbing in the region of relatively short waves is a perylene-3,4,9,10-tetracarboxylic acid derivative.

18. Electrophotographic recording material according to claim 1 in which the pigment dye absorbing in the region of relatively short waves is a quinacridone.

19. Electrophotographic recording material according to claim 1 in which the pigment dye absorbing in the region of relatively short waves is a perinone.

20. Electrophotographic recording material according to claim 1 in which the pigment dye absorbing in the region of relatively short waves is a naphtholylene-naphthimidazole-(1',2')-peri-dicarboxylic acid derivative.

21. Electrophotographic recording material according to claim 1 in which the pigment dye absorbing in the region of relatively short waves is a thioindigo dyestuff.

22. Electrophotographic recording material according to claim 1 in which the pigment dye absorbing in the region of relatively short waves is a condensation product of benzo-4,10-thioxanthene-3,1'-dicarboxylic acid anhydride and amines.

* * * * *

UNITED STATES PATENT AND TRADEMARK OFFICE

CERTIFICATE OF CORRECTION

PATENT NO. : 3,992,205

DATED : November 16, 1976

INVENTOR(S) : Wolfgang Wiedemann

It is certified that error appears in the above-identified patent and that said Letters Patent are hereby corrected as shown below:

Item [30] has been omitted and should read as follows:

Foreign Application Priority Data

October 26, 1973 Germany ..... 2353639.

Column 9, line 56, "T = 2,800 K" should read - - - T = 2,800° K --.

Column 10, line 1, the formula should read as follows:

$$f = \frac{U_H + \Delta U_D}{U_o}$$

Signed and Sealed this

Fifteenth Day of March 1977

[SEAL]

*Attest:*

RUTH C. MASON
*Attesting Officer*

C. MARSHALL DANN
*Commissioner of Patents and Trademarks*